US008398232B2

(12) United States Patent
Sugiura

(10) Patent No.: US 8,398,232 B2
(45) Date of Patent: Mar. 19, 2013

(54) CONSUMABLE PRODUCT ACCOMMODATING DEVICE, LIQUID EJECTION DEVICE, AND METHOD FOR CONTROLLING CONSUMABLE PRODUCT ACCOMMODATING DEVICE

(75) Inventor: Kunimitsu Sugiura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 110 days.

(21) Appl. No.: 13/165,902

(22) Filed: Jun. 22, 2011

(65) Prior Publication Data

US 2011/0316952 A1 Dec. 29, 2011

(30) Foreign Application Priority Data

Jun. 25, 2010 (JP) ..... 2010-144977

(51) Int. Cl.
*B41J 2/01* (2006.01)

(52) U.S. Cl. ..... 347/104

(58) Field of Classification Search ..... 347/5, 17, 347/94, 101, 104
See application file for complete search history.

(56) References Cited

U.S. PATENT DOCUMENTS 6,474,883 B1 11/2002 Kawakami et al.
7,798,631 B2 * 9/2010 McConville et al. ..... 347/102
8,157,462 B2 * 4/2012 Hirabayashi ..... 400/693.1
8,197,060 B2 * 6/2012 Maekawa ..... 347/108

FOREIGN PATENT DOCUMENTS

JP 11-198471 A 7/1999
JP 2001-158141 A 6/2001
JP 2009-226696 A 10/2009

* cited by examiner

*Primary Examiner* — An Do
(74) *Attorney, Agent, or Firm* — Global IP Counselors, LLP

(57) ABSTRACT

A consumable product accommodating device includes an accommodating body, a cushioning member, a weight detecting unit and a control unit. The accommodating body accommodates a consumable product whose weight decreases due to being fed to a consumption side, and is consumed with the accommodating body being configured and arranged to move between a first position and a second position. The cushioning member applies a cushioning force to the accommodating body when the accommodating body moves between the first position and the second position with the cushioning force resisting a movement of the accommodating body. The weight detecting unit is configured and arranged to detect the weight of the consumable product accommodated in the accommodating body. A control unit is configured to control magnitude of the cushioning force applied by the cushioning member according to the detected weight of the consumable product.

19 Claims, 6 Drawing Sheets

CONSUMABLE PRODUCT ACCOMMODATING DEVICE, LIQUID EJECTION DEVICE, AND METHOD FOR CONTROLLING CONSUMABLE PRODUCT ACCOMMODATING DEVICE

CROSS-REFERENCE TO RELATED APPLICATIONS

This application claims priority to Japanese Patent Application No. 2010-144977 filed on Jun. 25, 2010. The entire disclosure of Japanese Patent Application No. 2010-144977 is hereby incorporated herein by reference.

BACKGROUND

1. Technical Field

The present invention relates to a consumable product accommodating device, a liquid ejection device comprising the consumable product accommodating device, and method for controlling the consumable product accommodating device.

2. Related Art

There are known liquid ejection devices having an image forming part in which a liquid (e.g., an ink) is ejected, and caused to adhere, from a liquid ejection head onto a medium (e.g., a paper sheet or the like) to form a predetermined image (including text and graphics) on the medium. In a liquid ejection device of such description, the medium is also a consumable product that is consumed by being fed to the image forming part. In an instance in which, e.g., the liquid is ejected onto a medium that is provided in a large number of sheets or a medium that has a long length in the direction in which the medium is transported, and an image is formed, it is necessary for the medium to be supplied continuously to the image forming part, i.e., a consumption side in which the medium is consumed for image formation. Therefore, a liquid ejection device of such description is provided with a consumable product accommodating device, configured so as to accommodate a consumable product comprising a medium having a long length in a state of being overlappingly rolled into a roll shape; and to cause the consumable product to rotate, thereby unrolling the roll-shaped medium and dispensing and feeding the medium towards the consumption side.

A consumable product accommodating device of such description is provided with an accommodating body for accommodating the consumable product, which is a roll-shaped medium. In an instance in which the medium has been unrolled and depleted from the accommodated consumable product, replacement work is carried out in which the consumable product accommodated in the accommodating body is replaced with a new consumable product.

For example, devices having a configuration in which a paper roll, which is the consumable product, is slidingly moved in a horizontal direction from an accommodating chamber as disclosed in Japanese Laid-Open Patent Application Publication No. 2009-226696 are used for this replacement work. In a device of such description, a worker performing the paper roll replacement work is able to use a sliding movement to pull out the paper roll from the position at which the paper roll is dispensed and fed towards the consumption side to the position at which replacement is possible, and thereby perform the paper roll replacement work.

In such a device, a cushioning member (e.g., a damper), for applying a cushioning force to resist an inertial force generated in the direction of movement in relation to the sliding movement of the accommodating body, is sometimes provided to the consumable product accommodating device. Providing the cushioning member makes it possible to cushion and suppress, so as to weaken, the inertial force generated with respect to the paper roll in the direction in which the paper roll is pulled out. As a result, it is possible to suppress abrupt movements of, e.g., an accommodating body accommodating a new and unused paper roll and having a heavier weight, and to cause the accommodating body to move slowly, thereby suppressing causes of faults and improving the operability of the pulling-out work performed by the worker.

SUMMARY

However, the paper roll accommodated in the accommodating body decreases in weight in correspondence with consumption of paper, resulting in a difference in the total weight of the accommodating body between a state in which it accommodates a new and unused paper roll and a state in which it accommodates a used paper roll having a reduced amount of remaining paper. As a result, the operating force for causing the accommodating body to slidingly move the accommodating body differs between a state in which a new and unused paper roll is accommodated in the accommodating body and a state in which a paper roll having a reduced amount of remaining paper is accommodated in the accommodating body or a state in which no paper roll is accommodated in the accommodating body. Specifically, the cushioning member is configured so as to apply a large cushioning force at all times so as to resist a large inertial force generated in the accommodating body when the accommodating body having the maximum total weight is moved. Therefore, in an instance in which the paper roll has been consumed and the total weight of the accommodating body has been reduced, the inertial force held by the accommodating body is smaller while the cushioning force from the cushioning member remains large, and a larger operating force is therefore required from the worker when the accommodating body is slidingly moved.

Also, there are instances in which the accommodating body moves so that there is a difference in height in relation to the direction of gravity. As is known, in an instance in which the accommodating body slidingly moves in the horizontal direction, inertial force is only generated when the accommodating body moves. In contrast, in an instance in which the accommodating body moves so that there is a difference in height, an inertial force is always acting in the direction of gravity, even in a state in which the accommodating body is not moving. Therefore, there is a need for a configuration that applies a cushioning force that is even larger than when the accommodating body slidingly moves in the horizontal direction. As a result, when the accommodating body is moved in the direction of gravity in an instance in which the paper roll has been consumed and the total weight of the accommodating body has been reduced, the large applied cushioning force acts as a resistance force against movement, and a larger operating force is therefore required from the worker. Therefore, even in an instance in which the total weight of the accommodating body is smaller, the worker must apply a large force to press the accommodating body down, and workload increases.

The present invention has been contrived in order to solve the above mentioned problems. A main object of the present invention is to provide a consumable product accommodating device in which it is possible to reduce the workload in relation to the work to move an accommodating body for accommodating a consumable product whose weight varies with consumption, and a liquid ejection device comprising a consumable product accommodating device of such description. Another object is to provide a method for controlling a consumable product accommodating device in which it is possible to reduce the workload in relation to the work to move an accommodating body for accommodating a consumable product whose weight varies with consumption.

In order to achieve the above-mentioned objects, a consumable product accommodating device according to a first aspect includes an accommodating body, a cushioning member, a weight detecting unit and a control unit. The accommodating body is configured and arranged to accommodate a consumable product whose weight decreases due to being fed to a consumption side and being consumed, the accommodating body being configured and arranged to move between a first position at which the consumable product is fed to the consumption side, and a second position at which an operation for accommodating the consumable product is performed. The cushioning member applies a cushioning force to the accommodating body when the accommodating body moves between the first position and the second position with the cushioning force resisting the movement of the accommodating body. The weight detecting unit is configured and arranged to detect the weight of the consumable product accommodated in the accommodating body. The control unit is configured to control magnitude of the cushioning force applied by the cushioning member according to the weight of the consumable product detected by the weight detecting unit.

According to this configuration, the cushioning force from the cushioning member is controlled in correspondence with the weight of the consumable product accommodated in the accommodating body. Specifically, in an instance in which the weight of the accommodating body which accommodates the consumable product is large, a large inertial force is generated in the moving accommodating body; therefore, a large cushioning force is applied so that no abrupt movement takes place in the direction of movement. In contrast, in an instance in which the consumable product has been consumed and the weight of the consumable product has been reduced, and the weight of the accommodating body has thereby been reduced, the generated inertial force is small, and a small cushioning force is therefore applied. As a result, in an instance in which the weight of the accommodating body is smaller, the accommodating body can be more readily moved, and the workload on the worker can therefore be alleviated.

In the consumable product accommodating device as described above, a height difference with respect to the direction of gravity is preferably present between the first position and the second position, and the cushioning member preferably applies the cushioning force when the accommodating body moves between the first position and the second position from a high position side to a low position side with respect to the direction of gravity with the cushioning force resisting the movement of the accommodating body.

According to this configuration, in an instance in which the accommodating body moves in the direction of gravity, the cushioning force from the cushioning member is controlled in correspondence with the weight of the accommodated consumable product. Specifically, in an instance in which the total weight of the accommodating body which accommodates the consumable product is large, a large cushioning force is applied so that the accommodating body does not abruptly move in the direction of gravity, i.e., fall. In contrast, in an instance in which the consumable product has been consumed and the weight has been reduced, and the total weight of the accommodating body has thereby been reduced, the cushioning force is smaller. As a result, in an instance in which the weight of the accommodating body is smaller, the accommodating body can be more readily moved in the direction of gravity, and the workload on the worker can therefore be alleviated.

In the consumable product accommodating device as described above, the accommodating body is preferably configured and arranged to swing about a shaft to move between the first position and the second position, and the cushioning member preferably generates a torque about the shaft and applies the cushioning force to the accommodating body when the accommodating body swings between the first position and the second position in a direction from a high position to a low position with respect to the direction of gravity with the torque resisting a swinging motion of the accommodating body.

According to this configuration, in an instance in which the accommodating body undergoes a swinging motion in the direction of gravity, the cushioning force from the cushioning member is controlled in correspondence with the weight of the accommodated consumable product. Specifically, in an instance in which the total weight of the accommodating body which accommodates the consumable product is large, a large cushioning force is applied so that the accommodating body does not abruptly swing in the direction of gravity, i.e., drop. In contrast, in an instance in which the consumable product has been consumed and the weight has been reduced, and the total weight of the accommodating body has thereby been reduced, the cushioning force is smaller. As a result, in an instance in which the weight of the accommodating body is smaller, the accommodating body can be more readily caused to swing in the direction of gravity, and the workload on the worker can therefore be alleviated.

In the consumable product accommodating device as described above, when the weight detecting unit detects a decrease in the weight of the consumable product accommodated in the accommodating body, the control unit is preferably configured to control the cushioning force applied by the cushioning member so as to weaken the cushioning force from the cushioning force applied before the weight has decreased, the cushioning force being weakened according to an amount of decrease in the weight.

According to this configuration, a control is performed so as to reduce the cushioning force from the cushioning member in correspondence with the amount of decrease in the weight of the consumable product accommodated in the accommodating body. Therefore, in an instance in which, e.g., the worker is moving the accommodating body, it is possible to move the accommodating body using an equivalent operating force in any state, from an unused state in which the consumable product accommodated in the accommodating body is new to a completely used state in which the consumable product accommodated in the accommodating body has been completely consumed. Therefore, workload on the worker can be alleviated.

In the consumable product accommodating device as described above, the weight detecting unit is preferably configured and arranged to detect the weight of the consumable product using an amount of the consumable product fed to the consumption side.

For example, the weight detecting unit obtains, as the amount fed, the length of the consumable product fed to the consumption side, performs a subtraction of the weight of the consumable product corresponding to the obtained length, and thereby detects the weight of the consumable product accommodated in the accommodating body. Therefore, according to this configuration, there is no need to, e.g., provide the accommodating body with a pressure sensor or a similar member for pressure measurement for detecting the weight of the consumable product, and the weight of the accommodating body itself can therefore be prevented from increasing. As a result, e.g., the force required to move the accommodating body can be prevented from increasing, and workload on the worker can therefore be alleviated.

In the consumable product accommodating device as described above, the weight detecting unit is preferably configured and arranged to detect the weight of the accommodating body in which the consumable product is accommodated to detect the weight of the consumable product.

According to this configuration, it is possible to provide, separately from the accommodating body, a member for pressure measurement for detecting the weight of the consumable product, and the weight of the accommodating body itself can therefore be prevented from increasing. As a result, e.g., the force required to move the accommodating body can be prevented from increasing, and workload on the worker can therefore be alleviated. Also, since it is possible to directly measure the weight of the accommodating body, it is possible to accurately detect the total weight of the accommodating body in a state in which the consumable product is accommodated.

The consumable product accommodating device as described above preferably further includes a temperature detecting unit configured and arranged to detect an ambient temperature of the cushioning member. The control unit is preferably configured to correct the cushioning force applied by the cushioning member according to the ambient temperature detected by the temperature detecting unit.

For example, in an instance in which the member for generating the cushioning force is a cushioning member (i.e., damper) in which viscous oil is used, the cushioning force varies in correspondence with the ambient temperature at which the cushioning member is used. According to this configuration, the ambient temperature of the cushioning member is detected, and it is therefore possible to control, in an appropriate manner, the cushioning force applied by the cushioning member in correspondence with the ambient temperature.

The consumable product accommodating device as described above preferably further includes an opening/closing lid for accommodating the consumable product in the accommodating body, and an open/close detecting unit configured and arranged to detect an opened state and a closed state of the opening/closing lid. When the open/close detecting unit detects the opened state of the opening/closing lid, the control unit is preferably configured to control the cushioning member so that the cushioning member applies the cushioning force that is larger than the cushioning force when the opening/closing lid is in the closed state.

The worker performs work to replace, with a new item, a consumable product that has been consumed, by opening the lid. In a state before the replacement of the consumable product, i.e., in a state in which the lid is closed, the weight of the consumable product has been reduced, and the cushioning force is therefore smaller. Then, the new consumable product is positioned in the accommodating body and the weight of the consumable product therefore becomes heavier, in a state in which the lid has been opened in order to perform the replacement. According to this configuration, the cushioning force that is initially smaller is increased when the lid is in an opened state. Therefore, the cushioning force can be increased in advance in relation to, e.g., the accommodating body in which the new consumable product is positioned and whose weight suddenly increases.

In the consumable product accommodating device as described above, the consumable product is preferably a roll-shaped medium in which a long medium is overlappingly rolled into a roll shape.

Since a roll-shaped medium continuously varies (i.e., decreases) in weight in correspondence with the amount of the medium fed, it becomes more likely to be able to control the cushioning force from the cushioning member in an appropriate manner in correspondence with the varying weight of the consumable product.

A liquid ejection device according to another aspect of the present invention includes the consumable product accommodating device configured as described above and a liquid ejection head configured and arranged to eject a liquid onto the consumable product fed to the consumption side.

According to this configuration, it is possible to provide a liquid ejection device in which the accommodating body can be moved in an instance in which the total weight of the accommodating body is smaller using an operating force that is similar to an instance in which the total weight of the accommodating body is greater, therefore making it possible to alleviate the workload on the worker.

A method according to another aspect of the present invention is a method for controlling a consumable product accommodating device for applying a cushioning force on an accommodating body accommodating a consumable product whose weight decreases due to being fed to a consumption side and being consumed with the accommodating body being configured and arranged to move between a first position at which the consumable product is fed to the consumption side, and a second position at which an operation for accommodating the consumable product is performed with the cushioning force resisting a movement of the accommodating body. The method includes: detecting the weight of the consumable product accommodated in the accommodating body; and controlling magnitude of the cushioning force according to the weight of the consumable product detected.

According to this method, the cushioning force from the cushioning member (e.g., a damper) is controlled in correspondence with the weight of the consumable product accommodated in the accommodating body. Therefore, in an instance in which the weight of the accommodating body which accommodates the consumable product is large, a large inertial force is present in the moving accommodating body. Therefore, a large cushioning force is applied so that the accommodating body does not abruptly move in the direction of movement. In contrast, in an instance in which the consumable product has been consumed and the weight of the consumable product has been reduced, and the weight of the accommodating body has thereby been reduced, the generated inertial force is small, and a small cushioning force is therefore applied. As a result, in an instance in which the weight of the accommodating body is smaller, the accommodating body can be more readily moved, and the workload on the worker can therefore be alleviated.

BRIEF DESCRIPTION OF THE DRAWINGS

Referring now to the attached drawings which form a part of this original disclosure.

DETAILED DESCRIPTION OF EXEMPLARY EMBODIMENTS

A description will now be given, with reference to the accompanying drawings, for an embodiment in which the present invention is applied to an inkjet printer (may be abbreviated to "printer" hereafter), which is a type of a liquid ejection device for ejecting ink, as the liquid, and forming an image onto a paper roll, which is the medium used as the consumable product.

The medium is not limited to a paper roll (i.e., paper). A flexible substrate or a metal plate, a plastic sheet, cloth, or any another long medium rolled into a roll shape may also be used as the consumable product.

Figure 1:
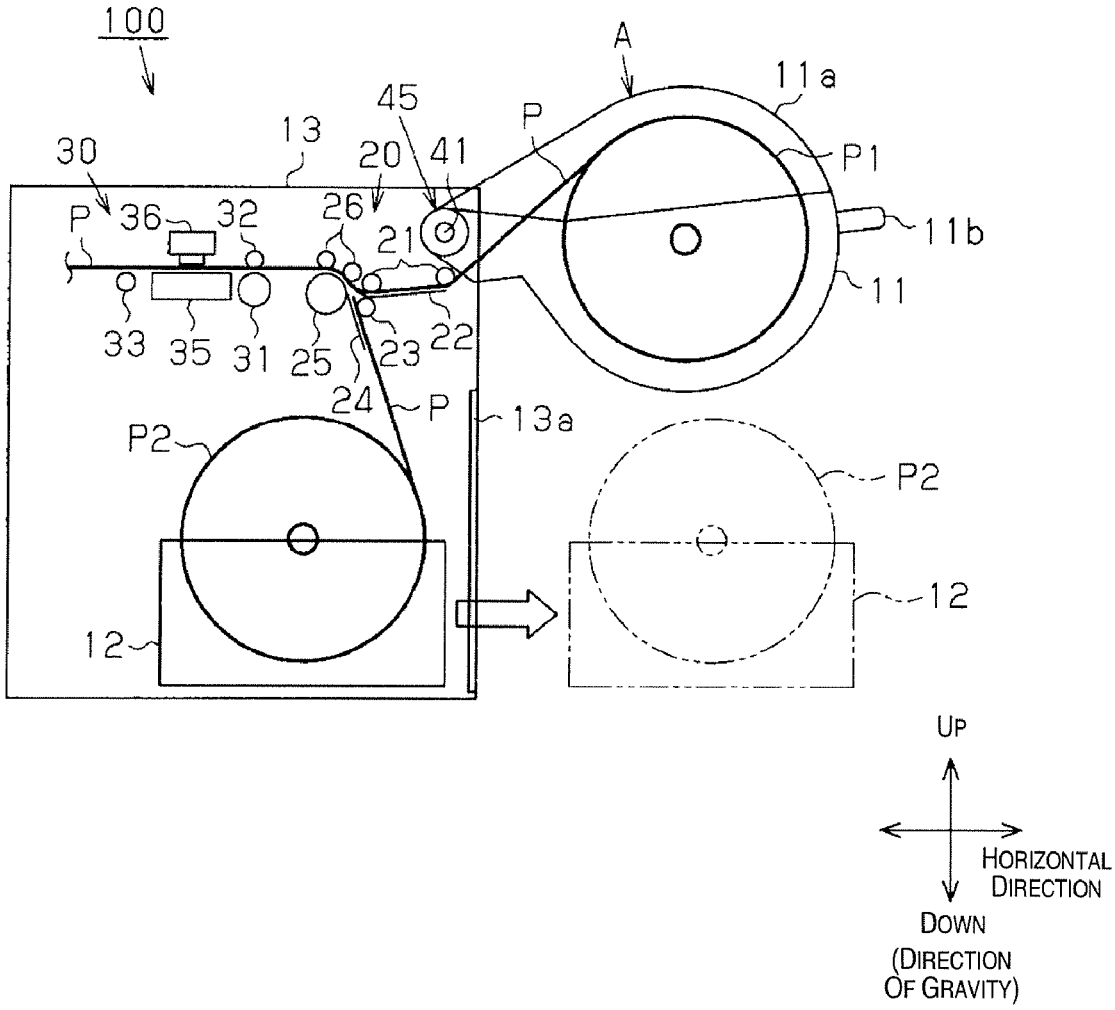
FIG. 1 is a schematic diagram showing an overview of a configuration of a printer according to an embodiment of the present invention.
Figure 3:
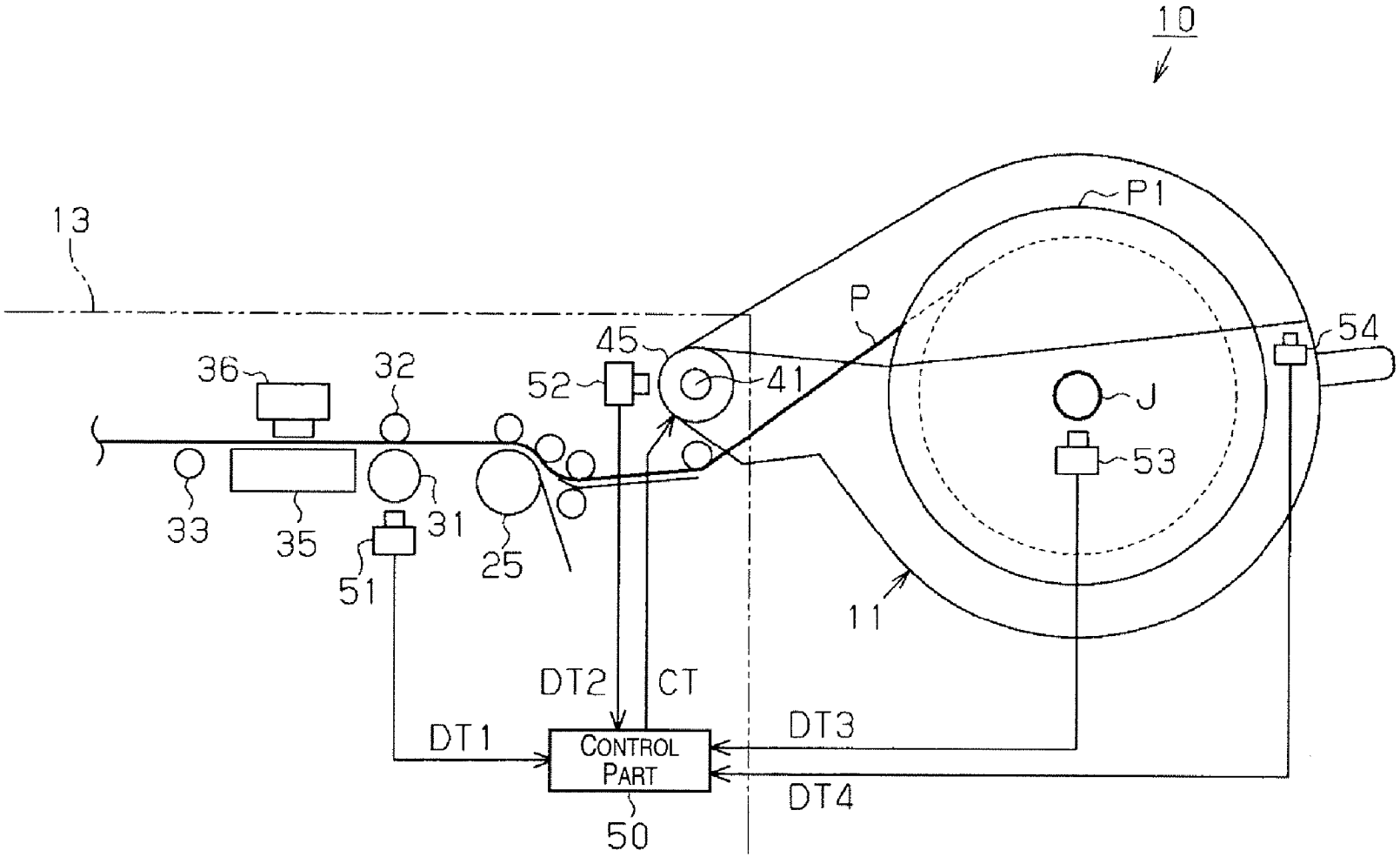
FIG. 3 is a diagram used to illustrate a control configuration in relation to the consumable product accommodating device.

FIG. 1 is a schematic configuration diagram of a printer 100 comprising a consumable product accommodating device 10 according to the present embodiment (see FIG. 3). As shown in FIG. 1, the printer 100 has a substantially box-shaped casing 13 which represents an external housing. A tray 12, which is an accommodating body for accommodating a paper roll P2 which represents a feed source of paper P consumed by printing, is arranged in the interior of the casing 13. A paper roll accommodating body (simply referred to as "accommodating body" hereafter) 11, which is an accommodating body having a housing structure for accommodating a paper roll P1 in an interior space, is provided outside the casing 13, the paper roll P1 similarly representing a feed source of paper P. A paper roll is paper P having a long length (i.e., continuous paper) overlappingly rolled into a roll shape. The paper roll rotates about an axis, whereby the paper P is unrolled from the paper roll and fed to the consumption side.

The accommodating body 11 is attached to the casing 13, in the vicinity of the upper part of the casing 13, in a state of being capable of swinging about a shaft 41. A rotary-type damper (i.e., a rotary damper) 45, which represents a cushioning member for applying a cushioning force about the shaft 41 to resist a swinging motion of the accommodating body 11 when a swinging operation is performed on the accommodating body 11, is attached to at least one shaft end part of the shaft 41.

A lid 11*a* that can be opened and closed is provided to the accommodating body 11. Specifically, the accommodating body 11 is configured so that the paper roll P1 can be replaced with a new item by placing the lid 11*a* in an opened state. A handle 11*b*, for the worker to hold when performing a swinging operation on the accommodating body 11 during replacement of the paper roll P1, is provided to the accommodating body 11. The consumable product accommodating device according to the present embodiment is configured so that the workload on the worker is alleviated during the work to replace the paper roll P1. This will be described further below.

The tray 12 is configured so that it is possible to open a lid 13*a* provided on a side surface (i.e., a right side surface in FIG. 1) of the casing 13 and move (i.e., slide) the tray 12 in a horizontal direction (i.e., rightwards in the drawing) perpendicular to the direction of gravity (i.e., downwards in the drawing), whereby it is possible to extract the tray 12 to the exterior of the casing 13. Performing such an operation makes it possible to replace the paper roll P2 with a new, unused item in a state in which the tray 12 is extracted to the exterior of the casing 13 (i.e., in the vicinity of a lower part of the right external side of the casing 13 in the instance shown in FIG. 1). In this state, the accommodating body 11 is held at a position A by a locking mechanism (not shown) without moving in the direction of gravity (i.e., dropping) and without interfering with the tray 12 and the paper roll P2 that are being extracted, the position A being a first position, further above the tray 12 and the paper roll P2, at which the paper P is fed to the consumption side, as shown in FIG. 1.

The printer 100 also comprises a paper roll switching part 20 and a printing part 30 provided in the stated order oriented toward the downstream side in the direction in which the paper P is transported, the printing part 30 representing a consumption side with regards to the paper P that has been unrolled from the paper rolls P1, P2. The paper roll switching part 20 comprises rollers 21, 23, a transportation drive roller 25, transportation driven rollers 26, and receiving plates 22, 24 for receiving the paper P; and switches the feed source of the paper P. Specifically, in an instance in which the feed source is the paper roll P1, the paper roll switching part 20 is configured so that the paper P extracted from the paper roll P1 is transported between the transportation drive roller 25 and two transportation driven rollers 26 by two rollers 21 and the receiving plate 22. In an instance in which the feed source is the paper roll P2, the paper roll switching part 20 is configured so that the paper P extracted from the paper roll P2 is transported between the transportation drive roller 25 and two transportation driven rollers 26 by a roller 23 and the receiving plate 24. The rollers 21, 23 are configured so as to rotatably operate in a direction that causes the paper P from the paper roll that does not represent the feed source to be rolled back as necessary when the paper roll that represents the feed source is switched.

The printing part 30 has a liquid ejection head 36 for ejecting ink, as the liquid; a support platform 35 for supporting the paper P that represents a target for ink ejection; a paper feed roller 31; a driven roller 32; and a paper discharge roller 33. The paper feed roller 31 and the driven roller 32 are configured to transport the paper P, which has been fed by the paper roll switching part 20, between the support platform 35 and the liquid ejection head 36. The liquid ejection head 36 ejects ink onto the paper P transported as described, and prints and forms an image or the like on the surface of the paper P. The liquid ejection head 36 can be configured using a so-called "serial-type" head, installed on a carriage that moves in the width direction of the transported paper P; or a so-called "line head-type" head in which nozzles are formed substantially across the width of the paper on a main head body, the main head body being longer than the width direction dimension of the paper P and being fixed along the width direction of the paper P The paper P, having undergone printing in the printing part 30, is cut to a predetermined length in the direction of transportation by a cutting device (not shown), and transported to a discharge tray or another discharge position (again, not shown). Thus, the paper P from each of the paper roll P1 and the paper roll P2 is consumed.

In an instance in which, in the state shown in FIG. 1, the paper P extracted from paper roll P1 has been fed to the printing part 30, printed, and thereby completely consumed, it is necessary to switch the feed source of the paper P to be used from the paper roll P1 to the paper roll P2 and replace the paper roll P1 in the accommodating body 11 with a new item.

Figure 2A:
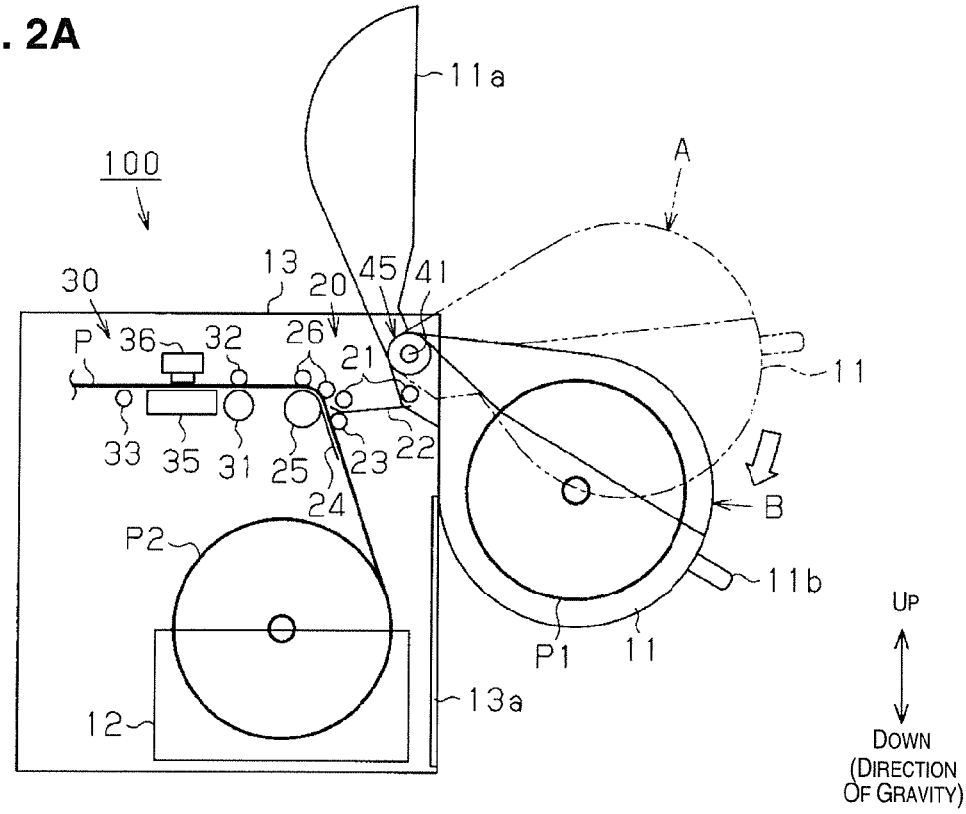
FIG. 2A is a schematic diagram showing an overview of a configuration of the printer during paper roll replacement work.

This work to replace the paper roll P1 will now be described with reference to FIGS. 2A and 2B. FIG. 2A is a schematic configuration diagram of the printer 100 showing a state in which the accommodating body 11 is at position B, which is a second position at which it is possible to perform an accommodating operation when the paper roll P1 is being replaced; and FIG. 2B is a perspective view of the printer 100 in the state shown in FIG. 2A in which the paper roll P1 is being replaced.

As shown in FIG. 2A, while grasping the handle 11*b* provided to the accommodating body 11, the worker disengages a lock (not shown) of the locking mechanism which is holding the accommodating body 11 at the upward position A. The accommodating body 11, upon being unlocked, is subjected by its own weight to an inertial force in the direction of gravity, so as to cause the accommodating body 11 to drop (i.e., fall).

Therefore, during the work of replacing the paper roll P1, the worker causes the accommodating body 11 to swing, with the shaft 41 representing the center of rotation, to the downward position B for replacing the paper roll P1, while grasping the handle 11*b* and supporting the accommodating body 11 so that the accommodating body 11 does not abruptly drop in the direction of gravity. Specifically, the accommodating body 11 is caused to swing (i.e., drop), with the shaft 41 representing the center of rotation, from position A represented by long dashed double-short dashed lines in FIG. 2A, which is the high position side in relation to the direction of gravity at which the paper roll P1 is in a state of normal use, to position B represented by solid lines in FIG. 2A, which is the low position side relative to this position A in relation to the direction of gravity. At position B, the lid 11*a* is opened, and the paper roll P1 whose paper P has been completely used is replaced with a new unused paper roll P1.

Figure 2B:
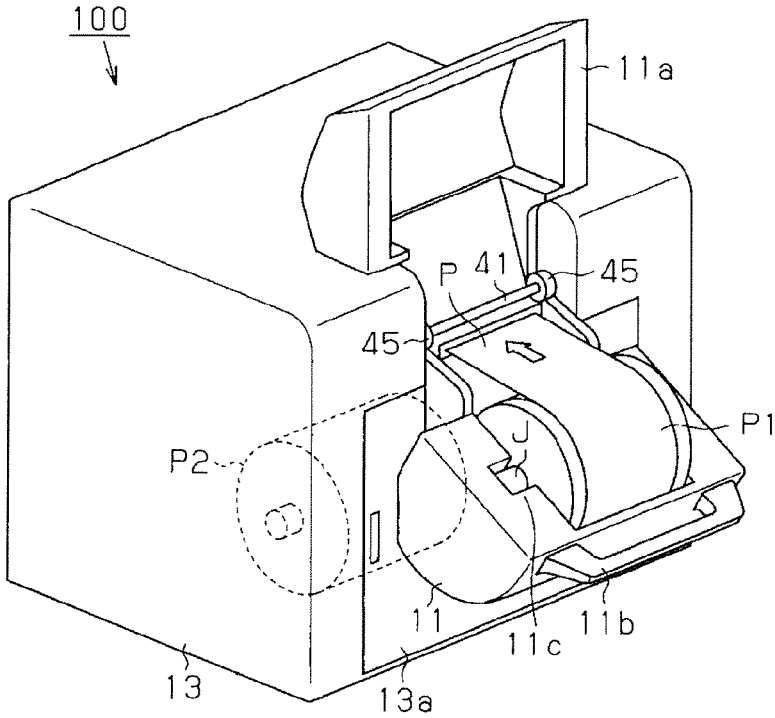
FIG. 2B is a perspective view of the same.

A rotating shaft J at both sides of the new paper roll P1 for replacement is inserted into a concave bearing part 11*c* provided to the accommodating body 11 as shown in FIG. 2B so that the paper roll P1 is supported in the accommodating body 11 and is capable of rotating. A front end portion of the paper P that has been unrolled from the paper roll P1 by this rotation is fed into and positioned in the casing 13 as shown by the white arrow in the drawing. The worker subsequently closes the lid 11*a*, then grasps and lifts the handle 11*b* upwards, causes the accommodating body 11 to swing (i.e., rise) about the shaft 41, and moves the paper P to position A at which the paper P is fed to the consumption side. Thus, the replacement work is completed.

In a state in which a new paper roll P1 is accommodated in the accommodating body 11, the paper P is yet to be used and is therefore at its heaviest. Therefore, the accommodating body 11 is subjected by its own weight to a large inertial force acting in the direction of gravity. Therefore, if, during a replacement work of such description, the worker accidentally lets go of the accommodating body 11 or the accommodating body 11 otherwise enters a state of being unsupported by the worker while the accommodating body 11 is being moved (i.e., caused to swing) from position B to position A, the accommodating body 11 drops, i.e., falls, abruptly. An abrupt fall of such description applies a large inertial force to the accommodating body 11, therefore generating a large impact upon, e.g., reaching position B; an abrupt fall is therefore not desirable. Therefore, in such an instance, it is necessary to apply a large cushioning force that resists the inertial force to the accommodating body 11 so that a large inertial force is not generated. Therefore, the damper 45 described above applies a large cushioning force (also referred to as a "damping force") that resists the inertial force to the accommodating body 11 so that the inertial force does not cause the accommodating body 11 to drop abruptly. This large damping force decreases the speed of travel (acceleration) of the accommodating body 11.

In contrast, the accommodating body 11 accommodating a paper roll P1 in a state in which the paper P has been completely consumed has a reduced weight. Therefore, the inertial force applied to the accommodating body 11 in the direction of gravity is smaller than in an instance in which a new paper roll P1 is accommodated. If the damping force applied to resist the inertial force remains large, the accommodating body 11 does not readily swing (i.e., drop) from position A to position B. Therefore, the speed of travel from position A to position B decreases, even in a state in which the worker is not supporting the accommodating body 11, i.e., a state in which the accommodating body 11 undergoes free fall. As a result, in the work of replacing the paper roll P1, the time taken to drop the accommodating body 11 from position A to position B increases.

In such an instance, it is necessary for the worker to e.g., perform adjustment work, such as reducing the force supporting the accommodating body 11 or conversely pressing the accommodating body 11 downwards, so that the speed at which the accommodating body 11 is dropped does not decrease. In other words, the worker cannot cause the accommodating body 11 to swing using an operating force that is similar to an instance in which the total weight is large. As a result, the workload on the worker for applying the swinging motion increases.

The damper 45 according to the present embodiment has a configuration that also makes it possible to adjust, in correspondence with the weight of the paper roll P1, the damping force applied to the accommodating body 11. For a damper of such description, a damper having, e.g., a structure for varying the area of contact with a viscous fluid, a structure for varying the flow area of a sealed fluid, or another known structure that can adjust the damping force, may be used. Also, the present embodiment has a known one-way clutch structure, in which a damping force is applied when the accommodating body 11 is lowered from position A to position B, while no damping force is applied when the accommodating body 11 is lifted from position B to position A. The damper 45 having a one-way clutch structure is thus used to prevent an increase in the operating force required from the worker when the accommodating body 11 is being lifted.

The consumable product accommodating device 10 according to the present embodiment is configured so as to be able to adjust the damping force applied to the accommodating body 11, the adjustment being performed in correspondence with the usage state of the paper P in the paper roll P1 described above, i.e., the weight of the paper roll P1 accommodated in the accommodating body 11. Thus, in an instance in which the total weight of the accommodating body 11 is large, the accommodating body 11 is prevented from dropping abruptly in the direction of gravity; and in an instance in which the total weight of the accommodating body 11 is small, it is possible to readily move the accommodating body 11 when the worker causes the accommodating body 11 to swing. The consumable product accommodating device 10 according to the present embodiment will now be described with reference to FIG. 3.

FIG. 3 is a schematic diagram showing a control configuration relating to the consumable product accommodating device 10 in the printer 100. The consumable product accommodating device 10 according to the present embodiment has the accommodating body 11 that rotates about the shaft 41; the damper 45, provided to both shaft end parts of the shaft 41, so as to apply a torque that resists the rotation of the accommodating body 11; and a control part 50 for controlling the size of the damping force in relation to the damper 45. The consumable product accommodating device 10 also comprises a rotation detection sensor 51 for detecting the amount of rotation of the paper feed roller 31; a temperature detection sensor 52 for detecting the ambient temperature (i.e., ambient operating temperature) of the damper 45; and an information detection sensor 53 for detecting information regarding the paper roll P1. The consumable product accommodating device 10 also comprises an open/close detection sensor 54 for detecting the open/close state of the lid 11*a* provided to the accommodating body 11. Each of the sensors 51 through 54 is configured so that detected data DT1 through DT4 is inputted into the control part 50.

The control part 50 is formed from a circuit board comprising a CPU or an ASIC and a memory device. The control part 50 performs circuit operation using a predetermined program or logic, and thereby performs a process of adjusting the damping force in the consumable product accommodating device 10 according to the present embodiment. In this process, the control part 50 detects the weight of the paper roll P1 using the detected data DT1 from the rotation detection sensor 51 and the detected data DT3 from the information detection sensor 53, and thereby corresponds to the weight detecting unit. The control part 50 also detects the ambient temperature of the damper 45 using the detected data DT2 from the temperature detection sensor 52, and thereby corresponds to the temperature detecting unit. The control part 50 also detects the open/close state of the lid 11*a* using the detected data DT4 from the open/close detection sensor 54, and thereby corresponds to the open/close detecting unit. The control part 50 also outputs a control signal CT to the damper 45, and thereby corresponds to the control unit for controlling the size of the damping force. The control part 50 may also be a control part for performing image formation control and other various types of operation control in the printer 100.

Figure 4A:
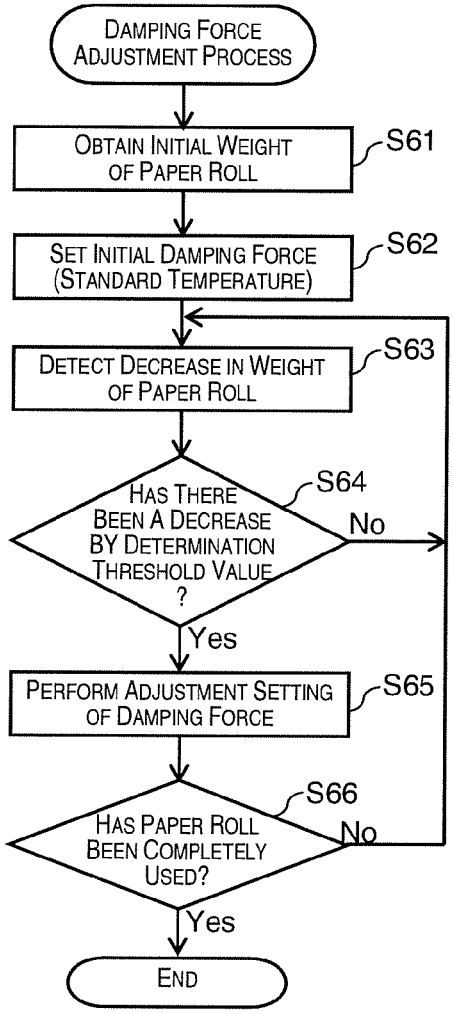
FIG. 4A is a flow chart showing an adjustment process routine in relation to the damping force.
Figure 4B:
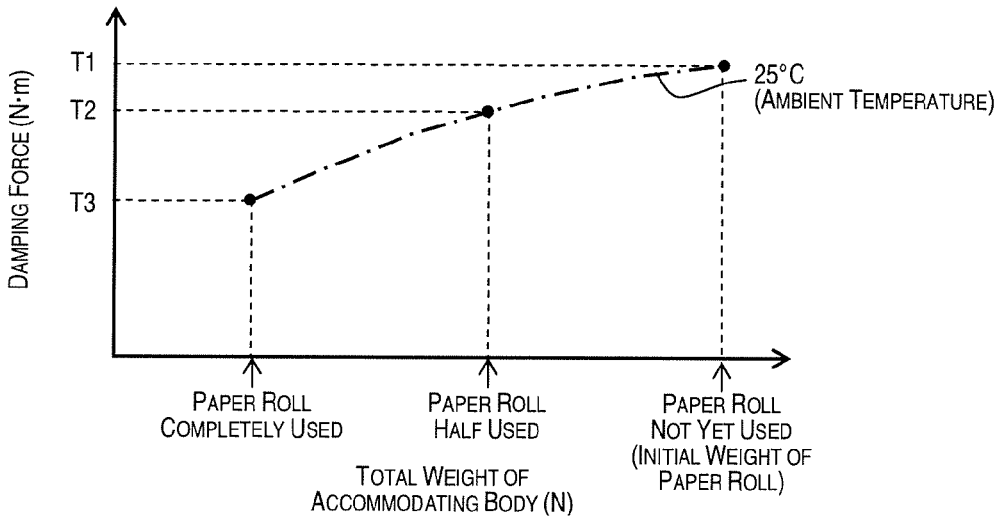
FIG. 4B is a graph showing adjustment values in relation to the damping force.

A description will now be given for an overview of a damping force adjustment process performed by the consumable product accommodating device 10 according to the present embodiment, with reference to FIG. 4. FIG. 4A is a flow chart showing a damping force adjustment process routine performed by the control part 50. FIG. 4B is a graph showing an example of the size of the damping force (N·m) set in relation to the total weight (N) of the accommodating body 11 in which the paper roll P1 is accommodated. The damping force adjustment process described here is, as an example, a process in which the damping force is adjusted in two steps and three types of damping force are set. The damping force shown in FIG. 4B is the torque (N·m) generated when the damper 45 rotates at a predetermined rotation speed at a standard ambient temperature (25° C. in this instance).

As shown in FIG. 4A, when the damping force adjustment process is launched, the control part 50 obtains the initial weight of the paper roll (step S61; the word "step" is omitted hereafter). At this step, the control part 50 uses the detected data DT3, read by the information detection sensor 53, relating to information regarding an IC chip installed on a part of the paper roll P1 (e.g., on the rotating shaft J), to obtain the weight, i.e., the initial weight, of the new paper roll P1 accommodated by the replacement work. For example, an IC chip having at least one unit of information that differs between individual paper rolls P1 is installed on the paper roll P1, and when this differing information is read by the information detection sensor 53 from the IC chip through contact or non-contact, the replacement work is determined to have been performed and the initial weight is therefore obtained. Alternatively, the initial weight may be obtained when the worker uses input means provided to the printer 100 to input a signal upon completion of the replacement work.

Next, the control part 50 sets an initial damping force (S62). In other words, the control part 50 controls the damper 45 using the control signal CT in correspondence with a total accommodating body weight (N), obtained by adding the weight of the accommodating body 11 stored in advance in the memory device to the obtained initial weight of the paper roll P1, and sets the initial damping force to damping force T1 as shown in FIG. 4B. For example, if the weight of the new paper roll P1 is 55 N, a weight corresponding to that of the accommodating body 11 is added, and a force of 58 N is applied as the cushioning force to the center of gravity of the accommodating body 11 that accommodates the paper roll P1. Therefore, if the distance between the shaft 41 and the center of gravity of the accommodating body 11 is 330 mm, the damping force T1 is 58×0.33=19.1 (N·m).

Next, the control part 50 detects the decrease in weight of the paper roll (S63). Specifically, the control part 50 uses the detected data DT1 for the amount of rotation of the paper feed roller 31 detected by the rotation detection sensor 51 to calculate the length of the paper P from the paper roll P1 that has been transported, i.e., consumed. The control part 50 then multiplies the calculated length of the paper P with the weight per unit length of the paper P to computationally obtain the weight of the paper P that has been consumed, and detects the computationally obtained value as the decrease in weight of the paper roll P1. The weight per unit length of the paper P is included in the detected data DT3 read by the information detection sensor 53, or may alternatively be stored in the memory device in advance.

Next, the control part 50 determines whether or not the weight of the paper roll P1 has decreased by the determination threshold value for adjusting the damping force (S64). At this step, the control part 50 uses, as the determination threshold value, the decrease in weight of the paper roll P1 when half of the paper P has been used. The determination is made by comparing the determination threshold value with the detected decrease in weight of the paper roll P1. The total weight of the paper P rolled around a new paper roll P1 (where the determination threshold value is half thereof) is included in the detected data DT3 read by the information detection sensor 53, or may alternatively be stored in the memory device in advance.

In an instance in which the result of the determination showed that the weight has not yet decreased by the determination threshold value, the flow returns to the process in S63, and detection of the decrease in weight is repeated. In an instance in which the result of the determination showed that the weight has decreased by the determination threshold value (i.e., "Yes" in S64), an adjustment setting is performed on the damping force (S65). Specifically, the control part 50 controls the damper 45 using a control signal CT in correspondence with the decreased total weight (N) of the accommodating body 11, and sets the damping force to damping force T2 as shown in FIG. 4B. The damping force T2 set in this step is the torque (N m) suitable for when the paper roll is in a half-used state in which half of the paper P rolled onto the paper roll P1 has been used and consumed.

Next, the control part 50 determines whether or not the paper roll has been completely used (S66). In this step, determination is made by the control part 50 by performing a comparison between the decrease in weight when the paper P rolled onto the paper roll P1 has been completely used, i.e., the initial total weight of the paper P rolled onto the paper roll P1, and the detected decrease in weight of the paper roll P1. In an instance in which the result of the determination showed that paper P is still remaining and the paper roll P1 has not been completely used (i.e., No in S66), the flow returns to the process in S63, and the detection of the decrease in weight of the paper roll is repeated.

When the processes of S63 and S64 are performed again, and the paper roll P1 is shown to have decreased again by the determination threshold value, i.e., the paper P of the paper roll P1 has been completely used in this instance (i.e., "Yes" in S64), an adjustment setting is again performed on the damping force applied by the damper 45 (S65). In this step, the control part 50 again controls the damper 45 using a control signal CT, and sets the damping force to damping force T3 as shown in FIG. 4B. The damping force T3 set in this step is the torque (N·m) suitable for when the paper roll is in a completely used state in which the paper P rolled onto the paper roll P1 has been completely used and consumed. Since the paper roll P1 has been completely used (i.e., "Yes" in S66), the damping force adjustment process is then completed.

In an instance in which the damper 45 has a known structure in which a viscous grease or another viscous fluid is used to generate the cushioning force, the value of the damping force (i.e., torque force) generated by the damper 45 varies according to the ambient temperature during use. For example, in general, the damping force increases with decreasing temperature, and the damping force decreases with increasing temperature. There are also instances in which the damping force varies by approximately 10% with a temperature difference of 20° C. In the present embodiment, a temperature correction process for correcting the damping force is performed in parallel with the damping force adjustment process.

Figure 5A:
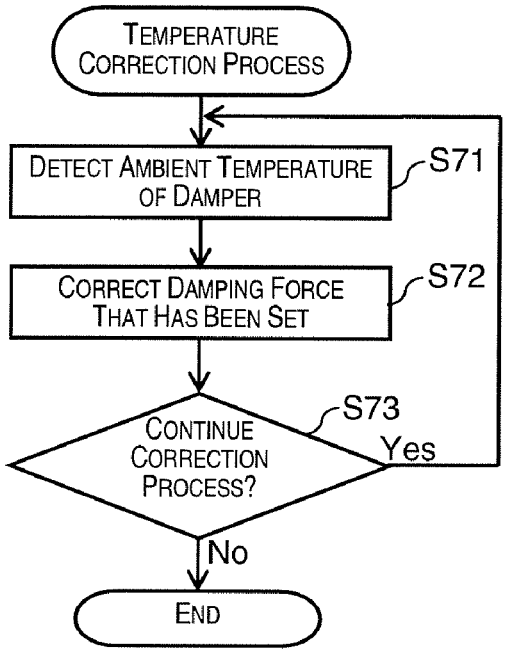
FIG. 5A is a flow chart showing a temperature correction process routine in relation to the damping force.
Figure 5B:
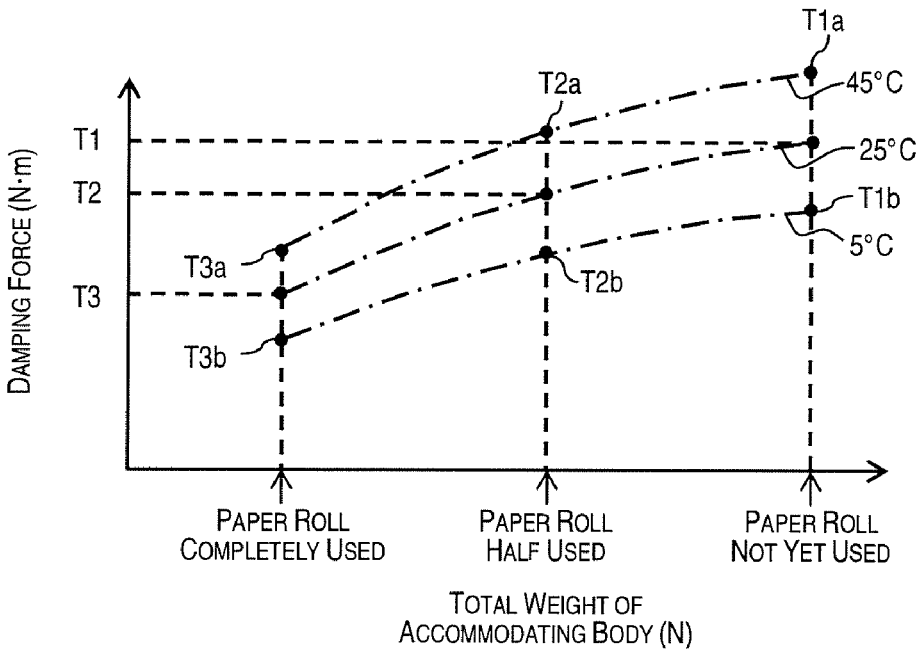
FIG. 5B is a graph showing corrective adjustment values in relation to the damping force.

A description for this process will now be given with reference to FIG. 5. FIG. 5A is a flow chart showing a temperature correction process routine performed by the control part 50. FIG. 5B is a graph that corresponds with FIG. 4B, and is a graph showing an example of the size of the damping force (N·m) upon which correction setting is performed according to the ambient temperature, in relation to the total weight (N) of the accommodating body 11 in which the paper roll P1 is accommodated.

As shown in FIG. 5A, when the temperature correction process routine is launched, the control part 50 first detects the ambient temperature of the damper (S71). In this step, the control part 50 detects, from the detected data DT2 from the temperature detection sensor 52, the ambient temperature at which the damper 45 is being used. Next, the control part 50 corrects the damping force that has been set (S72). Specifically, the control part 50 corrects, in correspondence with the detected ambient temperature, the damping force that has been set in the damping force adjustment process (i.e., FIG. 4A, S62 and S65). An example of this correction will now be described with reference to FIG. 5B.

As described further above, the initial damping force set in the damping force adjustment process has a value that corresponds to an ambient temperature of 25° C. If, for example, the detected ambient temperature is 45° C., the damping force during actual use decreases. Therefore, the damping force is corrected to damping force T1*a*, which has a greater value than the damping force T1, so as to compensate for this decrease. Alternatively, if the detected ambient temperature is 5° C., the damping force during actual use increases. Therefore, the damping force is corrected to damping force T1*b*, which has a smaller value than the damping force T1, so as to offset this increase.

Similarly, the damping forces T2, T3 upon which adjustment setting has been performed in S65 have a value that corresponds to an ambient temperature of 25° C. If, for example, the detected ambient temperature is 45° C., the damping forces during actual use decrease. Therefore, the damping forces are corrected to damping forces T2*a*, T3*a*, each of which has a greater value than the damping forces T2, T3 respectively, so as to compensate for this decrease. Alternatively, if the detected ambient temperature is 5° C., the damping forces during actual use increase. Therefore, the damping forces are corrected to damping forces T2*b*, T3*b*, each of which has a smaller value than the damping forces T2, T3 respectively, so as to offset this increase.

The example of temperature correction shown in FIG. 5B is only an example. The damping force may be corrected, e.g., in an instance in which a predetermined temperature difference occurs, or otherwise in correspondence with the temperature characteristics of the damper 45 that is used. The method for correcting the damper 45 may also be decided in correspondence with the range of the limit within which the damping force can be adjusted or the spacing by which the damping force can be corrected. Thus, temperature correction can be performed on the damping force in an appropriate manner in correspondence with the performance of the damper 45 to be used.

Next, the control part 50 determines whether or not to continue this damping force correction process (S73). In the present embodiment, the damping force correction process is performed in parallel with the damping force adjustment process. Therefore, when the paper P in the paper roll P1 has been completely used and consumed, the control part 50 discontinues the correction process (i.e., "No" in S73), and completes the process with the completion of the damping force adjustment process. The worker may also control the performing of the temperature correction process by inputting a command signal for launching or completing the correction process into the control part 50 using input means provided to the printer 100.

In an instance in which the damping force temperature correction process is to be continued (i.e., "Yes" in S73), the processes in S71 and S72 are repeated. In this instance, the control part 50 repeats the processes in S71 and S72 at a predetermined frequency. In an instance in which the ambient temperature does not vary by a significant amount, the detection of the ambient temperature and execution of the correction process may also be performed only when the damping force is set.

In the consumable product accommodating device 10 according to the present embodiment, an openable/closable lid 11*a* is provided in order to accommodate the paper roll P1 in the accommodating body 11. The worker opens the lid 11*a* and thereby performs the work of replacing a paper roll P1, whose paper P has been consumed, with a new item. In other words, a state in which the lid 11*a* provided to the accommodating body 11 is open is a state in which the work of replacing the paper roll P1 is performed. Therefore, when the new paper roll P1 is positioned in the accommodating body 11 when the lid 11*a* is in a state of having been opened for the replacement, the weight of the paper roll P1 increases significantly. In contrast, the state in which the lid 11*a* is closed is the state before replacement of the paper roll P1; in other words, the weight of the paper roll P1 is smaller. Therefore, the damping force is set to a small force. In this instance, there are instances in which the damping force remains small until an initial damping force that corresponds with the obtained initial weight of the paper roll P1 is set (S62) in the damping force adjustment process described further above. Therefore, a problem is presented during this time in that a damping force that resists a large inertial force cannot be obtained, resulting in a rapid fall as described further above.

Therefore, in the present embodiment, a lid open/close response process is also performed. This process is a process for increasing the damping force when the lid 11*a* so as to increase the damping force in advance with respect to the accommodating body 11 in which, e.g., a new paper roll P1 is positioned and whose total weight increases. Therefore, this process is performed at least during the work to replace the paper roll P1, i.e., during the course of the moving (swinging) work from when the accommodating body 11 is moved downwards from position A to position B until the accommodating body 11 is moved upwards from position B to position A and held at position A.

Figure 6:
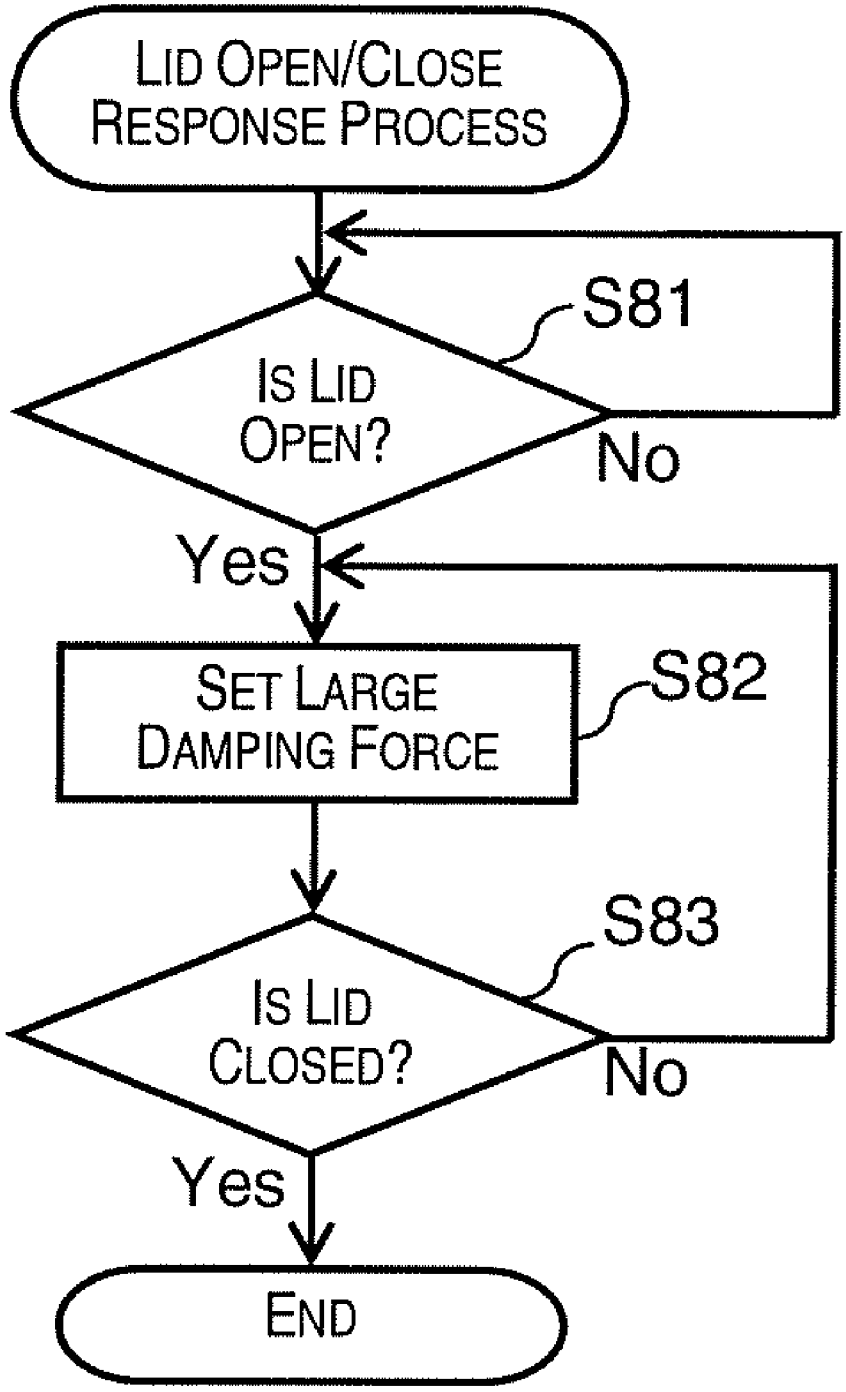
FIG. 6 is a flow chart showing a lid open/close response process routine.

The lid open/close response process routine performed by the control part 50 will now be described with reference to the flow chart shown in FIG. 6. As shown in FIG. 6, when the lid open/close response process routine is launched, the control part 50 determines whether or not the lid is open (S81). In this step, the control part 50 detects whether or not the lid 11*a* is open using detected data DT4 from the open/close detection sensor 54.

When the control part 50 detects that the lid 11*a* is open (i.e., "Yes" in S81), the control part 50 sets the damping force to a large force (S82). In other words, the control part 50 sets the damping force applied by the damper 45 to a large force using a control signal CT. Specifically, the control part 50 sets the damping force to a large damping force that is suitable for the total weight of the accommodating body 11 when the paper roll P1 is new, i.e., to an initial damping force. The control part 50 thereby prepares for an instance in which the total weight of the accommodating body 11 is at its heaviest. Before the lid 11*a* is opened, damping force T3 is set as the damping force when the ambient temperature is 25° C. if the paper roll P1 is in a completely used state. Then, the process described above performs a modification setting on the damping force applied by the damper 45 from damping force T3 to a large initial damping force, i.e., damping force T1.

Next, the control part 50 determines whether or not the lid has closed (S83). Specifically, the control part 50 detects whether or not the lid 11*a* has closed using detected data DT4 from the open/close detection sensor 54. When the lid is not in a closed state (i.e., "No" in S83), the setting of the large damping force (i.e., the initial damping force in this instance) is repeated, thereby maintaining the state in which a large damping force, which resists the total weight of the accommodating body 11 that accommodates a new paper roll P1, is set. When the control part 50 detects that the lid 11*a* has closed (i.e., "Yes" in S83), the control part 50 completes the process in this instance.

The following effects can be obtained using the embodiment described above.

(1) In an instance in which the accommodating body 11 is caused to swing in the direction of gravity, the damping force applied by the damper 45 is controlled in correspondence with the weight of the accommodated paper roll P1. Therefore, in an instance in which the total weight of the accommodating body 11 in which the paper roll P1 is accommodated is small, it is possible to cause the accommodating body 11 to swing more readily in the direction of gravity. As a result, the workload on the worker can be alleviated.

(2) The damping force applied by the damper 45 is controlled so as to decrease in correspondence with the amount of decrease in the weight of the paper roll P1 accommodated in the accommodating body 11. Therefore, in an instance in which, e.g., the worker is moving the accommodating body 11, it is possible to move the accommodating body 11 using an equivalent operating force in any state from an unused state, in which the paper roll P1 accommodated in the accommodating body 11 is new, to a completely used state. Therefore, workload on the worker can be alleviated.

(3) The length of the paper P fed from the paper roll P1 to the consumption side is obtained as the feed amount, a subtraction is performed using the weight of the paper P corresponding to the obtained weight, whereby the weight of the paper roll P1 accommodated in the accommodating body 11 is detected. Therefore, there is no need to, e.g., provide the accommodating body 11 with a pressure sensor or a similar member for pressure measurement for detecting the weight of the consumable product, and the weight of the accommodating body 11 itself can therefore be prevented from increasing. As a result, e.g., the force required to move (swing) the accommodating body 11 can be prevented from increasing, and workload on the worker can therefore be alleviated.

(4) In an instance in which the damping force (i.e., the torque) varies in correspondence with the ambient temperature in which the damper 45 is used, the damping force applied by the damper 45 can be controlled in correspondence with the ambient temperature in an appropriate manner since the ambient temperature of the damper 45 is detected.

(5) When the worker performs work to open the lid 11*a* to replace, with a new item, a paper roll P1 in which the paper P has been consumed and used up, the damping force is smaller in the state before replacement of the paper roll P1, i.e., a state in which the lid 11*a* is closed, because the paper roll P1 is depleted and the weight of the accommodating body 11 is smaller. Therefore, if, in this state, an unused paper roll P1 is newly accommodated, there is a risk of the accommodating body 11 abruptly falling. Therefore, in the present embodiment, the small damping force is increased when the lid 11*a* is in an opened state. Therefore, the damping force can be increased in advance in relation to the accommodating body 11 in which the new paper roll P1 is positioned and whose weight suddenly increases.

(7) It is possible to provide a printer 100 in which the accommodating body 11 can be moved in an instance in which the total weight of the accommodating body is smaller using an operating force that is similar to an instance in which the total weight of the accommodating body is greater, thereby making it possible to alleviate the workload on the worker.

The embodiment described above may be modified into another embodiment as follows.

The embodiment described above may be configured so that the lid open/close response process is always operating when the printer 100 is in an operating state (i.e., a state in which power is enabled). The worker may also control the performing of the lid open/close response process by inputting a command signal for launching or completing the process into the control part 50 using input means provided to the printer 100. For example, there may be instances, other than during work to replace the paper roll P1, in which the lid 11*a* is opened for inspection in an instance in which there is a fault in feeding of the paper P. Such instances may involve work in which the paper roll P1 is temporarily removed from, and then returned to, the accommodating body 11; and there is a risk of a large load being applied to the accommodating body 11 during this returning work. Therefore, the lid open/close response process is applied as described above, thereby increasing the damping force so as to be capable of resisting a large load applied during the returning work. The damping force to which adjustment setting had been performed when the lid 11*a* is opened is temporarily stored in the memory device, and the stored damping force is reapplied when the lid 11*a* is closed, whereby the damping force that has been set in correspondence with the weight of the paper P1 continues to be maintained when the lid is closed.

The embodiment described above may be configured so that the determination threshold value of the decrease in weight of the paper roll P1 is made smaller, whereby adjustment setting is performed on the damping force at smaller intervals along the graph line shown by a long dashed double-short dashed line in FIG. 4B or 5B. Since the paper roll P1 decreases in weight continuously in correspondence with the amount of the paper P that has been fed, reducing the width of adjustment of the damping force applied by the damper 45 and increasing the number of adjustment steps make it possible to adjust the damping force in an appropriate manner in correspondence with the decrease in weight of the paper roll P1 accommodated in the accommodating body 11. Therefore, it becomes more likely to be able to adjust the damping force in an appropriate manner in correspondence with the decrease in weight of the paper roll P1 in an instance of, e.g., replacing a paper roll P1 mid-use without the paper roll P1 having been completely used up. In an instance in which no replacement work is performed mid-use, i.e., in an instance in which replacement work is only performed when the paper roll P1 is in a state of having been completely used, the determination threshold value of the decrease in weight of the paper roll P1 may be set to the total weight of the paper P rolled around a new unused paper roll P1.

The embodiment described above may be configured so that the weight of the paper roll P1 is directly measured and detected using pressure measuring means (e.g., a pressure sensor), instead of using the amount of P that has been fed. For example, in FIG. 3, a pressure sensor for detecting the weight of the paper roll P1 may be provided, as with the information detection sensor 53, to the bearing part 11*c* of the accommodating body 11 (see FIG. 2B), wherein a pressure sensor thus provided is used to measure the force that is present when the rotating shaft J of the paper roll P1 is supported. It is thus possible to accurately measure the weight of the paper roll P1, therefore making it possible to accurately obtain the total weight of the accommodating body 11 in which the paper roll P1 is accommodated.

The embodiment described above may be configured so that the total weight of the accommodating body 11 is measured. Thus, it is possible to provide, separately to the accommodating body 11, a member for pressure measurement for detecting the weight of the paper roll P1, and the weight of the accommodating body 11 itself can therefore be prevented from increasing. As a result, e.g., the force required to move (swing) the accommodating body 11 can be prevented from increasing, and workload on the worker can therefore be alleviated. Since the weight of the accommodating body 11 is measured directly, it is possible to accurately detect the weight of the accommodating body 11 in the state in which the paper roll P1 is accommodated.

In the embodiment described above, the consumable product need not necessarily be a roll-shaped medium. For example, the consumable product may also be a sheet-shaped medium. In this instance, in the printer 100, the consumable product is fed in individual sheets to the consumption side. Therefore, the accommodating body 11 varies (decreases) in weight in a non-continuous, incremental manner, in correspondence with the amount of medium that is fed in individual sheets. Therefore, in the consumable product accommodating device 10, the damping force applied by the damper 45 may be adjusted in relation to the incrementally decreasing total weight of the accommodating body 11.

The embodiment described above may be configured so that the accommodating body 11 moves, e.g., vertically in a linear fashion or otherwise parallel to the direction of gravity, instead of undergoing a swinging motion about the shaft 41. Even in an instance in which the accommodating body 11 moves parallel to the direction of gravity, the damping force applied by the damper 45 is controlled in correspondence with the weight of the paper roll P1 that is accommodated, therefore making it possible to readily move the accommodating body 11 in the direction of gravity in an instance in which the weight of the accommodating body 11 is small. As a result, the workload on the worker can be alleviated.

The embodiment described above may be configured so that the damping force is adjusted during horizontal movement, such as that for the paper roll P2. For example, with regards to horizontal movement of the tray 12, a linear-type damper (linear damper) for applying a damping force that resists this horizontal movement is provided. The damping force applied by the linear damper is controlled in correspondence with the weight of the paper roll P2 accommodated in the tray 12. Thus, it is possible to readily move the tray 12 in the horizontal direction in an instance in which the total weight of the tray 12 in which the paper roll P2 is accommodated is small. As a result, the workload on the worker can be alleviated.

In the embodiment described above, the liquid ejection device is applied to an inkjet printer 100; however, a liquid ejection device for ejecting or discharging another liquid other than ink may also be used. The present invention may be applied to a variety of types of liquid ejection devices comprising a liquid ejection head or a similar component for discharging a very small amount of liquid droplets. Liquid droplets refer to a state of the liquid discharged from the liquid ejection device, and include those that are granular, those that are teardrop-shaped, and those that have a string-shaped tail. Also, a liquid refers to any material that can be ejected by the liquid ejection device. For example, a liquid may be any substance in a liquid-phase state, and includes not only high- or low-viscosity liquid bodies, sols, gel water, other inorganic solvents, organic solvents, solutions, liquid resins, liquid metals (i.e., metal melts), or other liquids in a fluid state or as a state of a substance; but also a substance in which pigments, metal particles, or other particles of solid functional materials have been dissolved, dispersed, or mixed in a solvent. A typical example of the liquid is ink such as that described in the above embodiment. Ink, in this instance, comprehensively refers to water-based ink, oil-based ink, gel ink, hot melt ink, and various other types of liquid compositions.

Although a specific example of the liquid ejection device is a device described in the above embodiment in which a paper roll accommodating body is provided with a paper roll in which paper is rolled into a roll shape. However, the present invention can be applied to any liquid ejection device in which a target for liquid ejection is rolled into a roll shape.

In the embodiment described above, the present invention is described as a consumable product accommodating device and a liquid ejection device comprising the consumable product accommodating device. However, as is apparent from the descriptions given above, an embodiment of the present invention may also be a method for controlling the consumable product accommodating device. This method has an effect that is similar to that of the embodiment described above.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A consumable product accommodating device comprising:

an accommodating body configured and arranged to accommodate a consumable product whose weight decreases due to being fed to a consumption side and being consumed, the accommodating body being configured and arranged to move between a first position at which the consumable product is fed to the consumption side, and a second position at which an operation for accommodating the consumable product is performed;

a cushioning member applying a cushioning force to the accommodating body when the accommodating body moves between the first position and the second position with the cushioning force resisting the movement of the accommodating body;

a weight detecting unit configured and arranged to detect the weight of the consumable product accommodated in the accommodating body; and a control unit configured to control magnitude of the cushioning force applied by the cushioning member according to the weight of the consumable product detected by the weight detecting unit.

2. The consumable product accommodating device according to claim 1, wherein a height difference with respect to the direction of gravity is present between the first position and the second position, and the cushioning member applies the cushioning force when the accommodating body moves between the first position and the second position from a high position side to a low position side with respect to the direction of gravity with the cushioning force resisting the movement of the accommodating body.

3. The consumable product accommodating device according to claim 2, wherein the accommodating body is configured and arranged to swing about a shaft to move between the first position and the second position, and the cushioning member generates a torque about the shaft and applies the cushioning force to the accommodating body when the accommodating body swings between the first position and the second position in a direction from a high position to a low position with respect to the direction of gravity with the torque resisting a swinging motion of the accommodating body.

4. A liquid ejection device comprising:

the consumable product accommodating device according to claim 3, and a liquid ejection head configured and arranged to eject a liquid onto the consumable product fed to the consumption side.

5. A liquid ejection device comprising:

the consumable product accommodating device according to claim 2, and a liquid ejection head configured and arranged to eject a liquid onto the consumable product fed to the consumption side.

6. The consumable product accommodating device according to claim 1, wherein when the weight detecting unit detects a decrease in the weight of the consumable product accommodated in the accommodating body, the control unit is configured to control the cushioning force applied by the cushioning member so as to weaken the cushioning force from the cushioning force applied before the weight has decreased, the cushioning force being weakened according to an amount of decrease in the weight.

7. A liquid ejection device comprising:

the consumable product accommodating device according to claim 6, and a liquid ejection head configured and arranged to eject a liquid onto the consumable product fed to the consumption side.

8. The consumable product accommodating device according to claim 1, wherein the weight detecting unit is configured and arranged to detect the weight of the consumable product using an amount of the consumable product fed to the consumption side.

9. A liquid ejection device comprising:

the consumable product accommodating device according to claim 8, and a liquid ejection head configured and arranged to eject a liquid onto the consumable product fed to the consumption side.

10. The consumable product accommodating device according to claim 1, wherein the weight detecting unit is configured and arranged to detect the weight of the accommodating body in which the consumable product is accommodated to detect the weight of the consumable product.

11. A liquid ejection device comprising:

the consumable product accommodating device according to claim 10, and a liquid ejection head configured and arranged to eject a liquid onto the consumable product fed to the consumption side.

12. The consumable product accommodating device according to claim 1, further comprising a temperature detecting unit configured and arranged to detect an ambient temperature of the cushioning member, the control unit is configured to correct the cushioning force applied by the cushioning member according to the ambient temperature detected by the temperature detecting unit.

13. A liquid ejection device comprising:

the consumable product accommodating device according to claim 12, and a liquid ejection head configured and arranged to eject a liquid onto the consumable product fed to the consumption side.

14. The consumable product accommodating device according to claim 1, further comprising an opening/closing lid for accommodating the consumable product in the accommodating body, and an open/close detecting unit configured and arranged to detect an opened state and a closed state of the opening/closing lid, when the open/close detecting unit detects the opened state of the opening/closing lid, the control unit is configured to control the cushioning member so that the cushioning member applies the cushioning force that is larger than the cushioning force when the opening/closing lid is in the closed state.

15. A liquid ejection device comprising:

the consumable product accommodating device according to claim 14, and a liquid ejection head configured and arranged to eject a liquid onto the consumable product fed to the consumption side.

16. The consumable product accommodating device according to claim 1, wherein the consumable product is a roll-shaped medium in which a long medium is overlappingly rolled into a roll shape.

17. A liquid ejection device comprising:

the consumable product accommodating device according to claim 16, and a liquid ejection head configured and arranged to eject a liquid onto the consumable product fed to the consumption side.

18. A liquid ejection device comprising:

the consumable product accommodating device according to claim 1, and a liquid ejection head configured and arranged to eject a liquid onto the consumable product fed to the consumption side.

19. A method for controlling a consumable product accommodating device for applying a cushioning force on an accommodating body accommodating a consumable product whose weight decreases due to being fed to a consumption side and being consumed with the accommodating body being configured and arranged to move between a first position at which the consumable product is fed to the consumption side, and a second position at which an operation for accommodating the consumable product is performed with the cushioning force resisting a movement of the accommodating body, the method comprising:

detecting the weight of the consumable product accommodated in the accommodating body; and controlling magnitude of the cushioning force according to the weight of the consumable product detected.

* * * * *